US010548423B1

(12) United States Patent
Rigas

(10) Patent No.: US 10,548,423 B1
(45) Date of Patent: Feb. 4, 2020

(54) COMBINATION CABINET MOUNTED AND COUNTERTOP KITCHEN KNIFE HOLDER

(71) Applicant: Peter Rigas, Yardley, PA (US)

(72) Inventor: Peter Rigas, Yardley, PA (US)

(73) Assignee: Tomzi International, Ltd., Yardley, PA (US)

( * ) Notice: Subject to any disclaimer, the term of this patent is extended or adjusted under 35 U.S.C. 154(b) by 0 days.

(21) Appl. No.: 16/033,242

(22) Filed: Jul. 12, 2018

(51) Int. Cl.
*A47G 21/14* (2006.01)
*A47F 7/00* (2006.01)

(52) U.S. Cl.
CPC ..... *A47G 21/14* (2013.01); *A47F 7/00* (2013.01); *A47G 21/145* (2013.01); *A47G 2200/106* (2013.01)

(58) Field of Classification Search
CPC ..... A47J 47/16; A47J 45/02; A47F 2001/103; A47F 7/00; A47G 21/04; A47G 21/14; A47G 29/087; A47G 2200/106; A47G 21/145
USPC ... 248/206.5, 37.3, 133, 371, 150, 136, 139, 248/140, 152; 211/70.7, 87.01
See application file for complete search history.

(56) References Cited

U.S. PATENT DOCUMENTS 2,733,113 A * 1/1956 Humbargar ..... A47B 81/007 206/45.24
3,195,021 A * 7/1965 Martin ..... A47J 47/16 335/285
3,490,601 A * 1/1970 Hain, Sr. ..... A47G 21/14 312/248
4,183,439 A * 1/1980 Bell ..... A47G 21/14 211/70.7
4,632,258 A * 12/1986 Borner ..... B26D 3/26 211/70.6
5,639,138 A * 6/1997 Smith ..... A47F 5/08 211/195
6,216,888 B1 4/2001 Chien
6,581,774 B1 * 6/2003 Galafassi ..... A47G 21/14 206/379
6,626,303 B1 * 9/2003 Moodie ..... A47F 5/0807 211/70.7
7,249,683 B2 * 7/2007 Smith ..... A47G 21/14 211/70.7
7,971,736 B1 * 7/2011 Stewart ..... B25H 3/04 211/70.7
8,122,800 B2 * 2/2012 Correa ..... A47J 47/005 220/507
8,276,768 B1 * 10/2012 Johnson ..... A47G 21/14 206/350
8,727,142 B2 * 5/2014 Shapiro ..... A47B 97/00 206/553
9,446,532 B2 9/2016 Nasrallah
2002/0116829 A1 8/2002 McLaughlin
2002/0175131 A1 11/2002 Johnson
(Continued)

*Primary Examiner* — Nkeisha Smith
(74) *Attorney, Agent, or Firm* — Joseph E. Maenner; Maenner & Associates, LLC

(57) ABSTRACT

A combination cabinet mountable and countertop kitchen knife holder includes a generally planar frame having a magnetic portion and an elongate side edge extending from the frame. The side edge has a plurality of co-linear through-holes extending therethrough. The through-holes are located to allow the holder to be mounted on the handle of a kitchen cabinet. The holder also includes a kickstand to enable the holder to sit on a kitchen counter.

17 Claims, 9 Drawing Sheets

(56) References Cited

U.S. PATENT DOCUMENTS

| | | | | |
|---|---|---|---|---|
| 2006/0022094 | A1* | 2/2006 | Schmidt | A47G 21/14 248/37.3 |
| 2008/0060205 | A1* | 3/2008 | Schmidt | A47G 21/14 30/298.4 |
| 2009/0101607 | A1 | 4/2009 | Zeng | |
| 2009/0314729 | A1* | 12/2009 | McCarthy | A47F 7/0042 211/87.01 |
| 2010/0269400 | A1* | 10/2010 | Gesik | A01K 97/06 43/54.1 |
| 2013/0037501 | A1* | 2/2013 | Schmidt | A47F 7/00 211/70.7 |
| 2013/0140414 | A1* | 6/2013 | Copeman | B62D 25/182 248/206.5 |
| 2016/0130876 | A1* | 5/2016 | Roseveare, Jr. | E06C 7/488 248/210 |

* cited by examiner

COMBINATION CABINET MOUNTED AND COUNTERTOP KITCHEN KNIFE HOLDER

BACKGROUND OF THE INVENTION

Field of the Invention

The present invention relates to a magnetic knife holder that can be mounted on a kitchen cabinet of stood on a countertop.

Description of the Related Art

Kitchen cutlery is typically stored in a large butcher block that can take up a significant portion of kitchen counter space. Often, many of the knives in the butcher block are rarely used, particularly by non-professional cooks. Alternatively, kitchen knives are stored in a drawer, which may lead to a person cutting themself when reaching in reaching into the drawer to get a knife.

It would be beneficial to provide a place to store frequently used knives without taking up a significant portion of counter space or risking a person cutting himself/herself when reaching into a drawer.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is combination cabinet mountable and countertop kitchen knife holder that includes a generally planar frame having a magnetic portion and an elongate side edge extending from the frame. The side edge has a plurality of co-linear through-holes extending therethrough. The through-holes are located to allow the holder to be mounted on the handle of a kitchen cabinet. The holder also includes a kickstand to enable the holder to sit on a kitchen counter.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
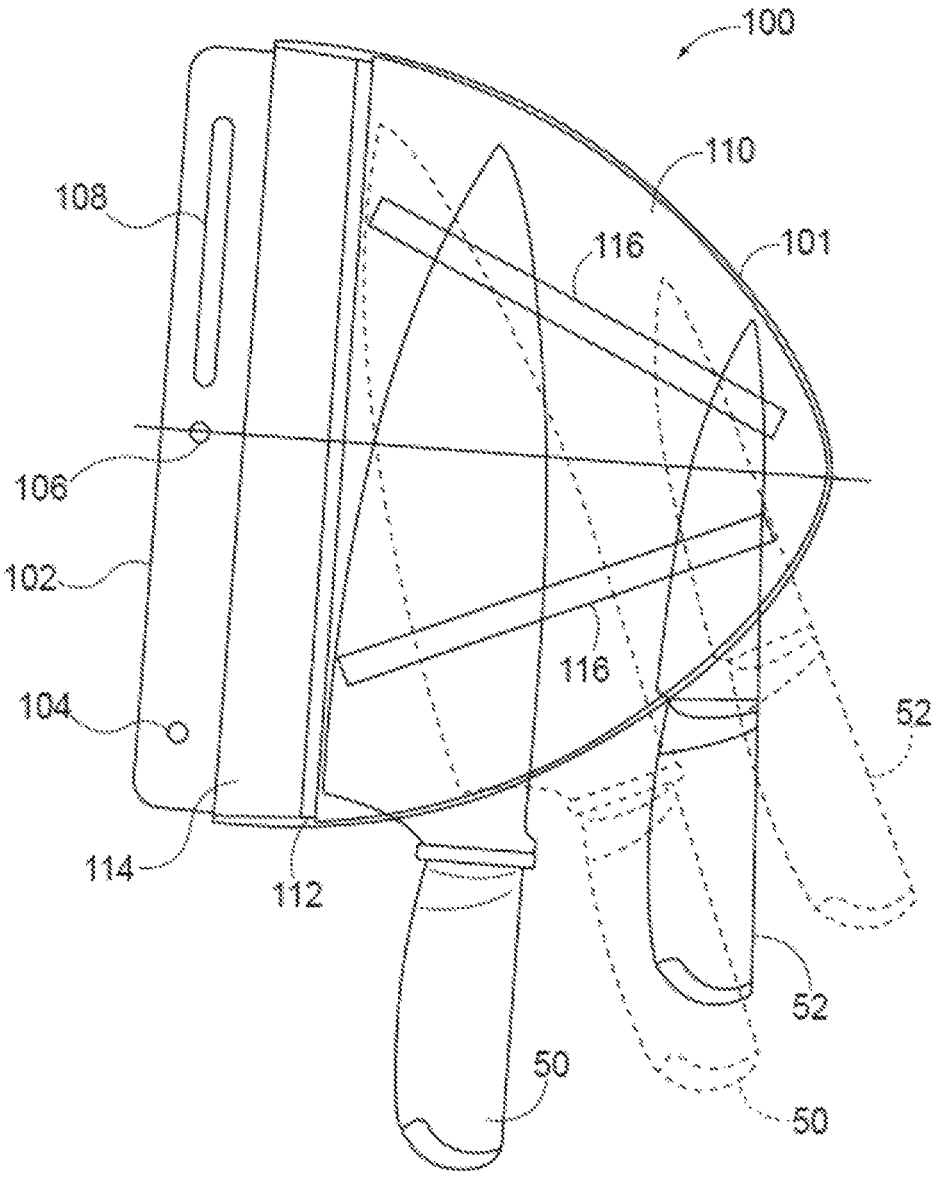
FIG. 1 is a front elevational view of a knife holder with knives according to an exemplary embodiment of the present invention.
Figure 2:
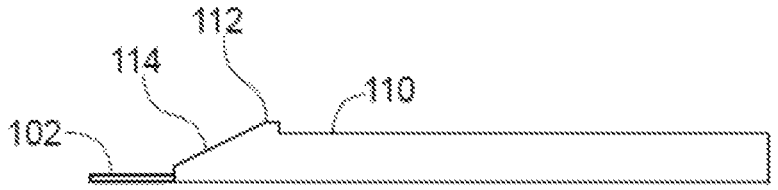
FIG. 2 is a side elevational view of the knife holder of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As shown in FIGS. 1-6, a combination cabinet mounted and countertop kitchen knife holder 100 ("holder 100") is shown. Holder 100 can be mounted on a kitchen cabinet door with a handle or a knob or, alternatively, holder 100 can be placed on a flat surface, such as a countertop 60.

Holder 100 includes a generally planar frame 101 having a side edge 102 with a plurality of co-linear through-holes 104, 106, 108 extending therethrough. Through-holes 104, 106 are generally circular holes, while through-hole 108 is a generally elongated hole. Through-holes 104, 106, 108 are sized and spaced to accept handles with different length spacings, such as, for example, 3", 3.75", 4", 96 mm, and 128 mm. For a cabinet door with a knob instead of a handle, holder 100 can be attached to the knob at through-hole 104.

A magnet face 110 is formed within frame 101. Frame 101 can be any general shape, although frame 101 is shown in FIG. 1 as being generally triangular, with a single straight side and the remaining two sides being curved. In an exemplary embodiment, holder 100 have a length of side edge 102 of about 5.6 inches; magnet face 110 can have a height from side edge 102 of about 6.5 inches; and magnet face 110 can have a thickness of about 0.5 inches, although those skilled in the art will recognize that holder 100 can have other dimensions as well.

In an exemplary embodiment, the single straight side includes a lip 112 extending outwardly from magnet face 110 to serve as a guard to keep the blades of knives 50, 52 away from the door handle. A tapered edge 114 can be located between the lip 112 and side edge 102 to provide a smooth transition between side edge 102 and lip 112.

Magnet face 110 can include at least one magnet 116 extending across magnet face 110, although two magnets 116 are shown in FIG. 1. Alternatively, entire magnet face 110 can be a magnet. In an exemplary embodiment, magnet 116 can be a neodymium magnet.

Figure 3:
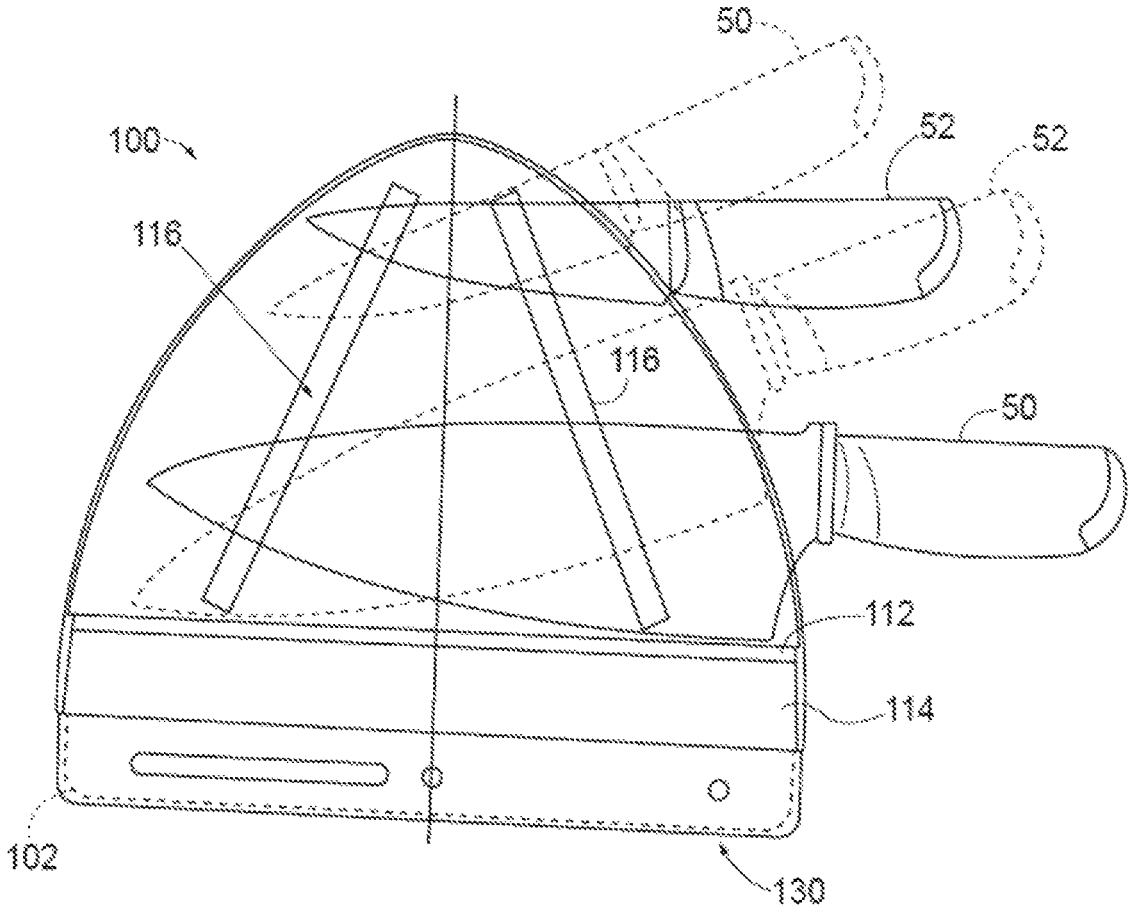
FIG. 3 is a front elevational view of the holder with knives of FIG. 1, with a removable cover attached to the holder.

As shown in FIGS. 1 and 3, knives 50, 52 can be releasably attached to magnet face 110 by placing the blades of knives 50, 52 against magnet face 110. Knives 50, 52 can be placed at any of a multitude of angles although, for stability, it is desired that the blades engage both of magnets 116. In an exemplary embodiment, holder 100 can hold a knife 50 with a 5 inch blade, such that the blade is wholly contained within the perimeter of the magnet face 110 to reduce the likelihood of a user inadvertently engaging any overhanging blade portion.

Figure 4:
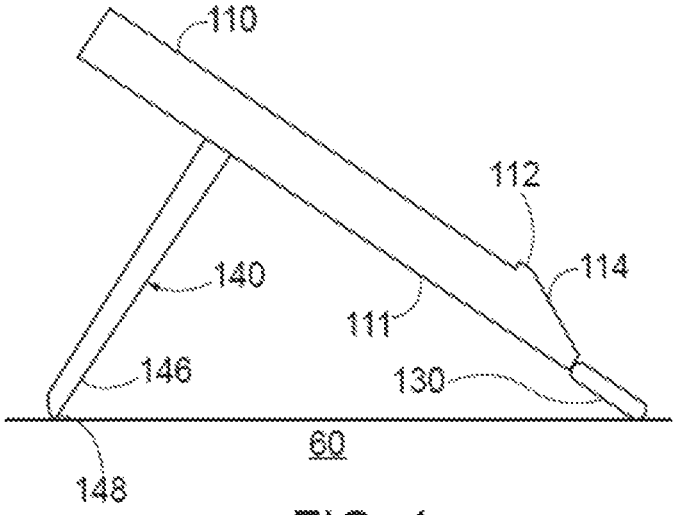
FIG. 4 is a side elevational view of the holder of FIG. 3, with a kickstand of the holder extended in a counter top position.
Figure 5:
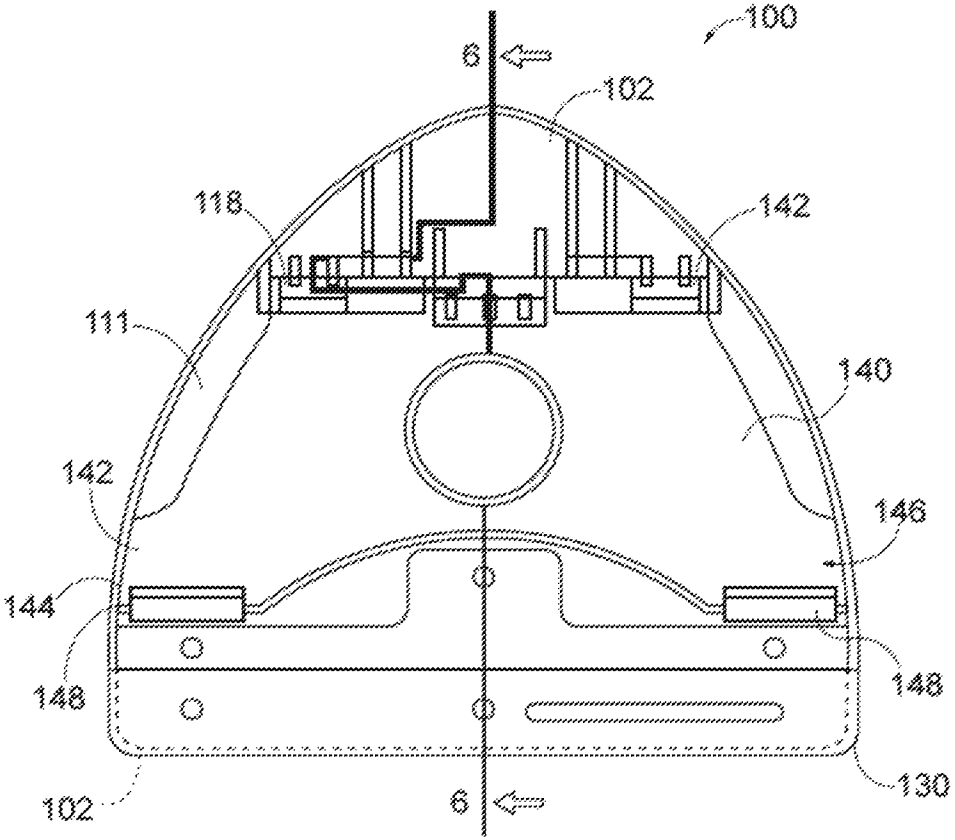
FIG. 5 is a rear elevational view of the holder of FIG. 1.
Figure 7:
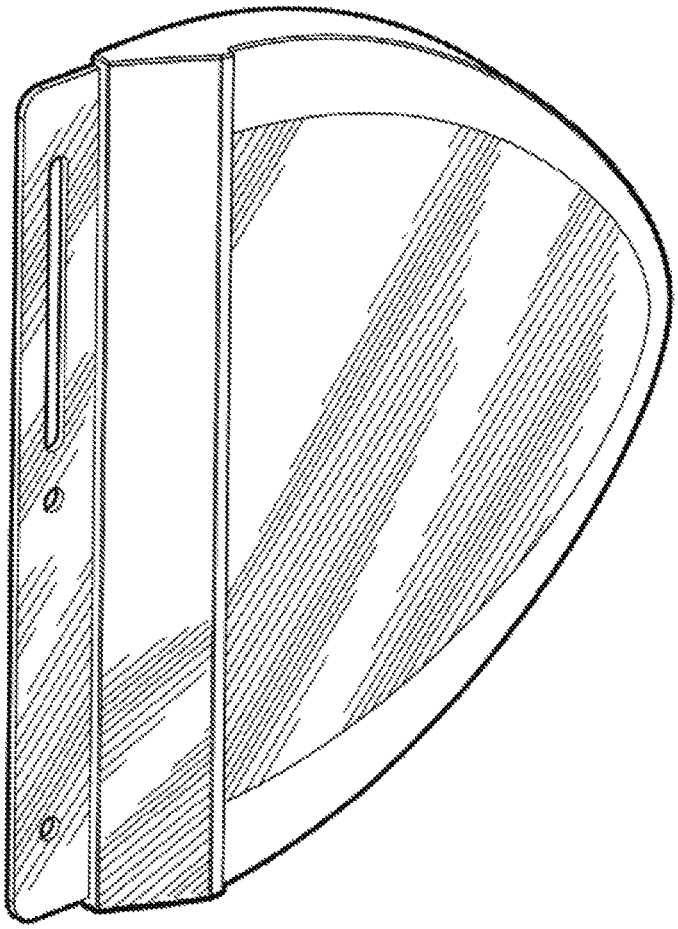
FIG. 7 is a front perspective view of an ornamental design of a magnetic knife holder with its stand in a retracted position.
Figure 8:
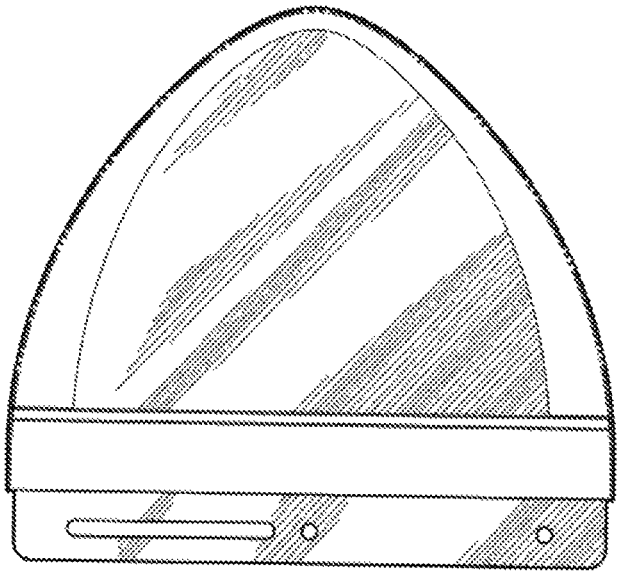
FIG. 8 is a front side elevational view thereof.
Figure 9:
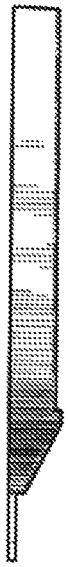
FIG. 9 is a right side elevational view thereof.
Figure 10:
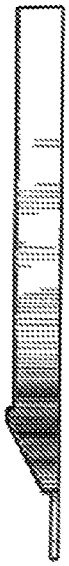
FIG. 10 is a left side elevational view thereof.
Figure 11:
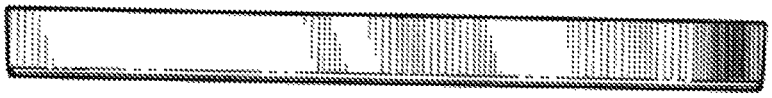
FIG. 11 is a top plan view thereof.
Figure 12:
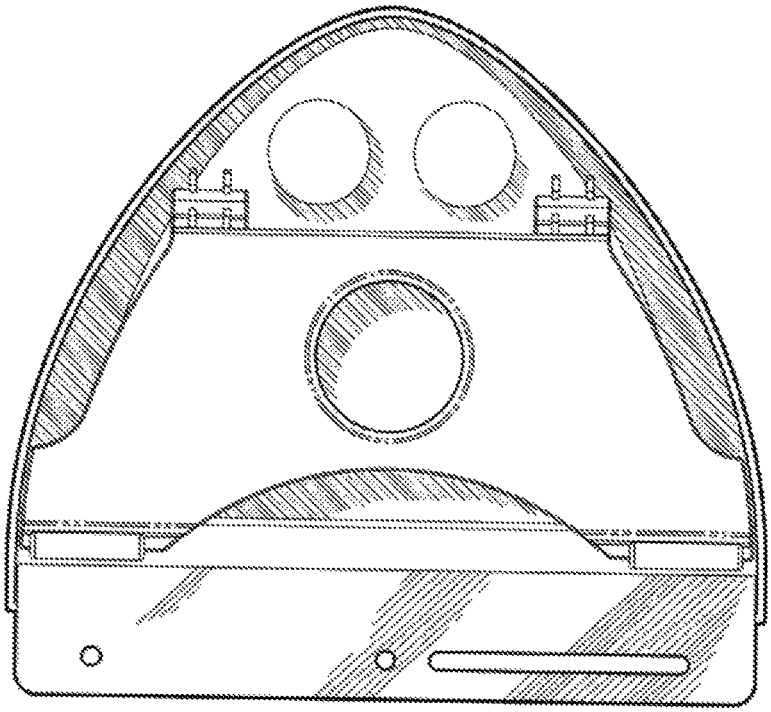
FIG. 12 is a rear elevational view thereof.
Figure 13:
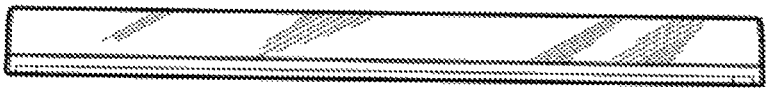
FIG. 13 is a bottom plan view thereof.
Figure 14:
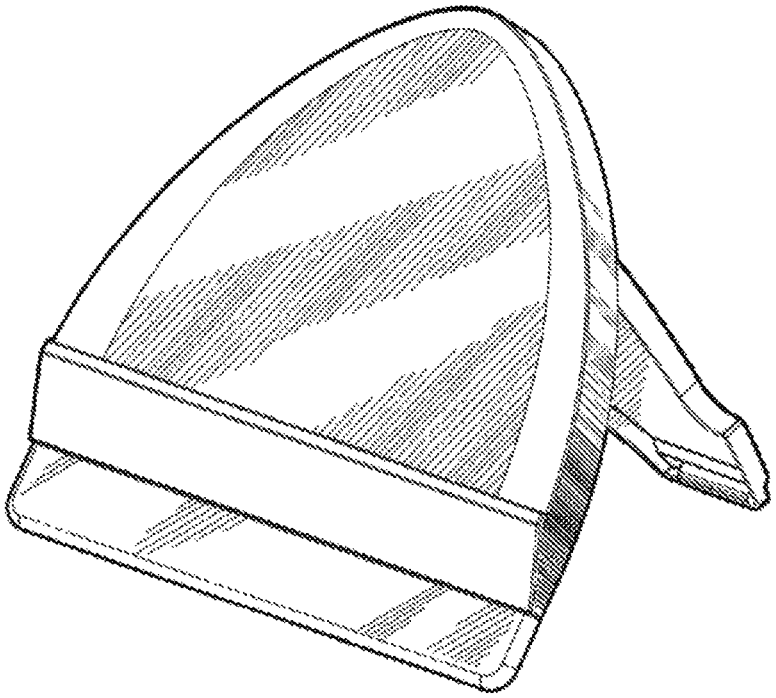
FIG. 14 is a is a front perspective view of an ornamental design of a magnetic knife holder with its stand in an extended position.
Figure 15:
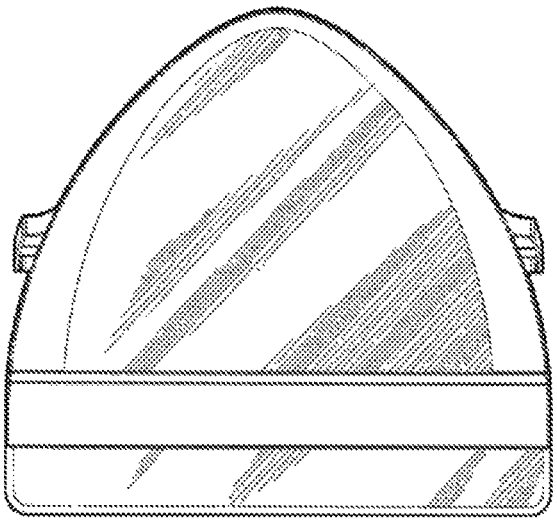
FIG. 15 is a front side elevational view thereof.
Figure 16:
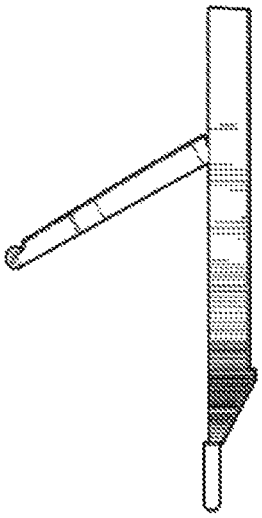
FIG. 16 is a right side elevational view thereof.
Figure 17:
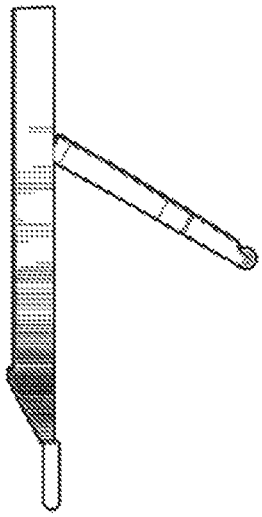
FIG. 17 is a left side elevational view thereof.
Figure 18:
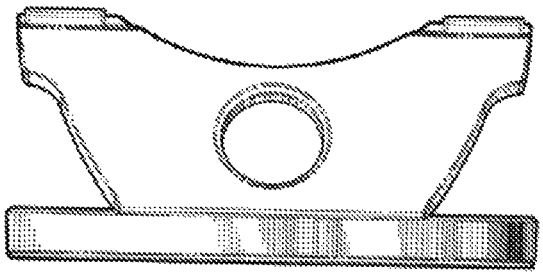
FIG. 18 is a top plan view thereof.
Figure 19:
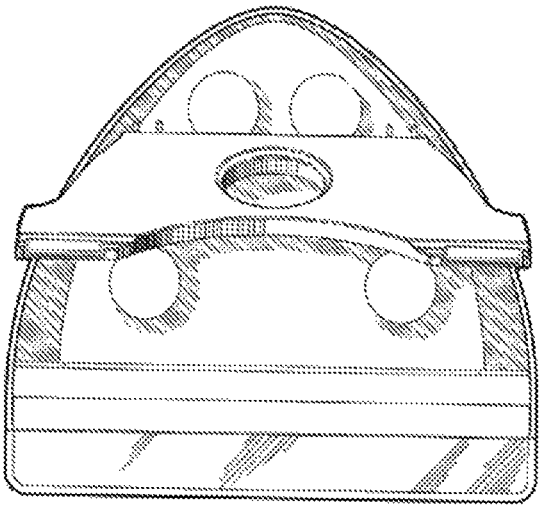
FIG. 19 is a rear elevational view thereof.
Figure 20:
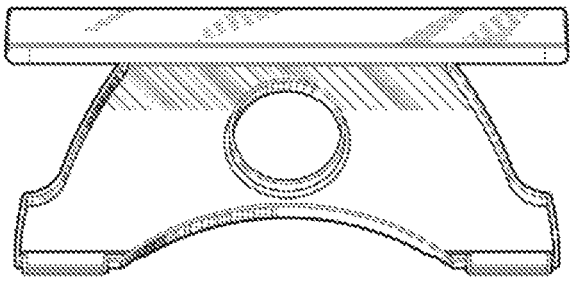
FIG. 20 is a bottom plan view thereof.

Referring to FIGS. 3-6, holder 100 also includes a removable cover 130 that can be slid over side edge 102 when holder 100 is used on a countertop. Cover 130 can be constructed from a flexible elastomer material. Holder 100 includes a pivoting kickstand 140 having a top end portion 142 pivotally connected to magnet face 110 that is pivotally connected to the rear 111 of frame 101 along a pivot rod 118. As shown in FIG. 5, kickstand 140 is connected to pivot rod 118 at four locations.

Kickstand 140 also includes a bottom portion 142 having a pair of feet 144, 146. Each foot 144, 146 includes a roller 148 that is adapted to engage a counter top so that, when kickstand 140 is in an open position, holder 100 can be placed on the counter top with so that knives 50, 52 are supported on holder 100 and displayed on the counter top.

Figure 6:
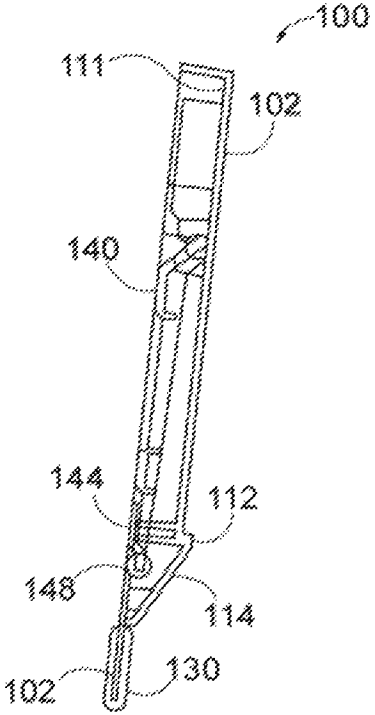
FIG. 6 is a side elevational view, in section of the holder of FIG. 5.

Kickstand 140 is pivotable between a closed position, as shown in FIG. 6, wherein feet 144,146 of kickstand 140 are against rear 111 of magnet face 110, and an open position, shown in FIG. 4, wherein feet 144, 146 of kickstand 140 are extended distally from rear 111 of magnet face 110. In an exemplary embodiment, as shown in FIG. 4, kickstand 140 extends at an angle of about 90 degrees relative to magnet face 110.

FIGS. 7-13 show different views of a knife holder according to an exemplary embodiment of the invention with the kickstand in a folded position and FIGS. 14-20 show different views of the knife holder of FIGS. 7-13 with the kickstand in an extended position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A combination cabinet mountable and countertop kitchen knife holder comprising:

a generally planar frame having a magnetic portion and extending in a first plane, wherein the magnetic portion comprises a magnet face;

an elongate side edge extending from the frame, the side edge having a plurality of co-linear through-holes extending therethrough and extending in a second plane, parallel to the first plane; and a lip extending between the magnet face and the side edge, wherein the lip extends outwardly from the magnet face.

2. The combination cabinet mountable and countertop kitchen knife holder according to claim 1, wherein at least one of the plurality of through-holes comprises an elongate through-hole.

3. The combination cabinet mountable and countertop kitchen knife holder according to claim 1, wherein the frame has a rear portion and wherein the side edge extends from the rear portion.

4. The combination cabinet mountable and countertop kitchen knife holder according to claim 1, further comprising a kickstand connected to the frame.

5. The combination cabinet mountable and countertop kitchen knife holder according to claim 4, wherein the kickstand is pivotally connected to the rear portion.

6. The combination cabinet mountable and countertop kitchen knife holder according to claim 5, wherein the kickstand comprises at least one foot.

7. The combination cabinet mountable and countertop kitchen knife holder according to claim 6, wherein the kickstand is pivotable between a closed position wherein the at least one foot is against the rear portion and an open position wherein the at least one foot is distal from the rear portion.

8. The combination cabinet mountable and countertop kitchen knife holder according to claim 7 wherein, when the kickstand is in the open position, the kickstand extends at an angle of about 90 degrees relative to the frame.

9. The combination cabinet mountable and countertop kitchen knife holder according to claim 1, further comprising a cover removably insertable over the side edge.

10. The combination cabinet mountable and countertop kitchen knife holder according to claim 1, wherein the frame has a generally triangular shape.

11. The combination cabinet mountable and countertop kitchen knife holder according to claim 1, wherein the magnetic portion comprises a plurality of magnets.

12. A combination cabinet mountable and countertop kitchen knife holder comprising:

a frame having:

a planar magnet face having a side;

a lip extending outwardly from the side;

a side edge having a plurality of through-holes extending therethrough; and a tapered edge located between the lip and the side edge; and a kickstand pivotally attached to the frame.

13. The combination cabinet mountable and countertop kitchen knife holder according to claim 12, wherein the magnet face extends in a plane and the lip extends above the plane.

14. The combination cabinet mountable and countertop kitchen knife holder according to claim 12, wherein the kickstand is pivotable to a stowed position such that the kickstand is contained wholly within the frame.

15. The combination cabinet mountable and countertop kitchen knife holder according to claim 12, wherein the magnet face extends in a first plane and wherein the side edge extends in a second plane, different from the first plane.

16. A combination cabinet mountable and countertop kitchen knife holder comprising:

a frame having:

a magnet face extending in a first plane; and a side edge extending along a side of the frame and having a plurality of through-holes extending therethrough, the side edge extending in a second plane different from the first plane; and a kickstand pivotally attached to the frame, the kickstand including a plurality of feet.

17. The combination cabinet mountable and countertop kitchen knife holder according to claim 16, wherein the kickstand is pivotal between a first position wherein the kickstand is wholly disposed within the frame and a second position wherein the feet extend outwardly of the frame.

* * * * *